US008439986B2

(12) United States Patent
Theaker

(10) Patent No.: US 8,439,986 B2
(45) **Date of Patent: *May 14, 2013**

(54) FUEL ADDITIVE

(75) Inventor: William Earnest Theaker, Port Elgin (CA)

(73) Assignee: 1692124 Ontario Inc., Toronto (CA)

( * ) Notice: Subject to any disclaimer, the term of this patent is extended or adjusted under 35 U.S.C. 154(b) by 0 days.

This patent is subject to a terminal disclaimer.

(21) Appl. No.: 13/289,093

(22) Filed: Nov. 4, 2011

(65) Prior Publication Data

US 2012/0042565 A1 Feb. 23, 2012

Related U.S. Application Data

(63) Continuation of application No. 12/307,517, filed on Jan. 5, 2009, now Pat. No. 8,057,557.

(30) Foreign Application Priority Data

Jul. 7, 2006 (CA) ..... 2551619

(51) Int. Cl.
*C10L 1/18* (2006.01)

(52) U.S. Cl.
USPC ..... 44/308

(58) Field of Classification Search ..... 44/308
See application file for complete search history.

(56) References Cited

U.S. PATENT DOCUMENTS 8,057,557 B2 * 11/2011 Theaker ..... 44/308

* cited by examiner

*Primary Examiner* — Cephia D Toomer
(74) *Attorney, Agent, or Firm* — Christopher L. Parmelee; Walker & Jocke

(57) ABSTRACT

A fuel additive for gasoline that increases automobile fuel efficiency and decreases carbon emissions. The fuel additive comprises a composition of olive oil and fuel oil in a ratio, by volume, of about 1 part olive oil to about 8 parts fuel oil. In the preferred embodiment the fuel oil is fuel oil no. 2-D.

12 Claims, No Drawings

FUEL ADDITIVE

This application is a continuation of U.S. application Ser. No. 12/307,517 filed Jan. 5, 2009, now U.S. Pat. No. 8,057,557.

FIELD OF THE INVENTION

This invention relates to fuel additives. In particular, the invention relates to fuel additives for gasoline used in combustion engines to improve fuel efficiency and thereby reducing carbon dioxide emissions.

BACKGROUND OF THE INVENTION

Most vehicles run on fuels derived from oil, such as gasoline. Oil is a non-renewable resource and is therefore in limited supply. Moreover, the use of oil in automobile engines is harmful to the environment.

Carbon dioxide, a greenhouse gas, is released from the exhaust of a gasoline combustion engine. In addition to causing air pollution, greenhouse gases build up in the Earth's atmosphere and trap heat. Some scientific research predicts that increases in concentrations of greenhouse gases will, over time, increase the average global temperature and thereby change the world's climate and weather patterns.

Carbon dioxide is one of many harmful bi-products of gasoline combustion. As combustion efficiency improves, the release of harmful bi-products during combustion decreases. Because fuel efficiency relates to the efficiency of converting energy contained in a fuel to kinetic energy or work to enable a vehicle to travel, fuel economy (i.e., the amount of fuel required to move a vehicle over a given distance) improves as fuel efficiency improves.

A fuel-efficient car is thus not only beneficial to the environment, but also benefits the consumer by saving gasoline costs. There is therefore a need to reduce the consumption of oil-based fuels generally and a particular need to make gasoline combustion engines more efficient.

DETAILED DESCRIPTION OF THE INVENTION

An object of this invention is to provide a fuel additive for use with oil-based fuels such as gasoline, which provides improved combustion efficiency. In the case of a gasoline combustion engine this results in both an increase in fuel mileage and a decrease in harmful emissions. The invention will thus be described in the context of an automobile combustion engine for purposes of explanation. However, it will be appreciated that there are a myriad uses and applications for oil-based fuels and for gasoline in particular. The invention is not intended to be limited to gasoline or to any specific application.

As those skilled in the art will appreciate, oil-based fuel refers to a number of combustible fluids made from crude oil. For example, gasoline, kerosene, range oil, and jet fuel.

The present invention relates to a fuel additive for fuels such as gasoline. A fuel additive according to the invention consists essentially of oil and fuel oil no. 2-D. The term oil as utilized herein refers to naturally occurring oils that are derived from animal or plant sources. Such oils may include coconut oil, babassu oil, palm kernel oil, palm oil, olive oil, castor oil, rape oil, beef tallow oil, whale oil, sunflower oil, cottonseed oil, linseed oil, tung oil, tallow oil, lard oil, peanut oil, soya oil, etc. In a preferred embodiment, a fuel additive according to this invention consists essentially of olive oil and fuel oil no. 2-D.

A suitable olive oil is an oil consisting of a blend of refined olive oil and virgin olive oils fit for consumption. It has a free acidity, expressed as oleic acid, of not more than 1 gram per 100 grams (1.0%). The cheap refined oil is mixed with a flavourful virgin olive oil (http://www.oliveoilsource.com/definitions.htm). The U.S.D.A. (United States Department of Agriculture) defines olive oil as the edible oil obtained from the fruit of the olive tree (*Olea europaea* L.); is clarified, has a specific gravity of 0.910 to 0.915 at 25° C./25° C.; has an iodine number (Hanus) of 79 to 90; has a refractive index of 1.4668 to 1.4683 at 25° C.; and is packed in containers suitable for preservation of the product (http://www.ams.usda.gov/standards/oliveoil.pdf).

Fuel oil no. 2-D is also known as diesel fuel, diesel fuel oil no. 2, diesel oil no. 2, no. 2 diesel, diesel oil (medium), and furnace oil no. 2. Fuel oil no. 2 is a distillate fuel which consists of distilled process streams. It is a heavier, usually blended, distillate with hydrocarbons in the $C_{11}$-$C_{20}$ range. The hydrocarbon composition of fuel oil no. 2 is found in Appendix A herein and its physical and chemical properties can be found in Appendix B herein.

In the preferred embodiment, a fuel additive embodying the invention is made by mixing a suitable olive oil and fuel oil no. 2-D in a forty-five gallon (170.34 liters) steel drum in the following amounts: 5 gallons (18.925 liters) olive oil and 40 gallons (151.4 liters) fuel oil no. 2-D. The fuel additive is therefore composed of about 1 part olive oil to about 8 parts fuel oil no. 2-D.

There are three applications of the present invention: 1) it may be used as a cleaner to flush the automotive engine; 2) it may be pre-added to and a component of gasoline; and 3) it may be an additive that is added by a user to regular gasoline.

As a cleaner, and for an initial 'shock' treatment, the additive of the present invention may be used at full strength by adding about 6 to 8 ounces (180 to 240 milliliters) of additive to a 60 to 80 litre automobile gasoline tank. For best results, the automobile should then be driven 400 to 600 kilometers.

If it is already pre-added to gasoline, the additive will be present in a ratio of about 4 to 6 ounces (120 to 180 milliliters) additive to about 60 to 80 liters gasoline.

In use in an automobile, on an ongoing basis increased fuel efficiency will be maintained if a user adds approximately 4 to 6 fluid ounces (120 to 180 milliliters) of a fuel additive according to the invention per 60 to 80 liters of gasoline when filling the vehicle at the fuel pump. A significant improvement in fuel efficiency may be seen after the initial shock treatment. The additive will continue to improve fuel efficiency when consistently used over time.

With various embodiments of the present invention having been thus described in detail by way of example, it will be apparent to those skilled in the art that variations and modifications may be made without departing from the invention. The invention includes all such variations and modifications as fall within the scope of the appended claims.

I claim:

1. A gasoline fuel composition comprising a fuel additive composition comprising a fuel oil and a natural oil, wherein the natural oil is derived from at least one of a plant and an animal, wherein said gasoline fuel additive is added to gasoline at a level from 120 to 180 milliliters (4 to 6 fluid ounces) per 60 to 80 liters (15.85 to 21.14 gallons) of gasoline.

2. The composition according to claim 1, wherein the fuel oil is fuel oil number 2-D.

3. The composition according to claim 2, wherein the natural oil is at least one of coconut oil, babassu oil, palm kernel oil, palm oil, olive oil, castor oil, rape oil, beef tallow oil, whale oil, sunflower oil, cottonseed oil, linseed oil, tung oil, tallow oil, lard oil, peanut oil, and soya oil.

4. The composition according to claim 3, wherein the natural oil includes a blend of a refined olive oil and a virgin olive oil.

5. The composition according to claim 1, wherein the natural oil and the fuel oil are present in a ratio, by volume of about 1 part natural oil to about 8 parts fuel oil.

6. A method of increasing the combustion efficiency of a gasoline engine, comprising:

a) adding to gasoline 120 to 180 milliliters (4 to 6 fluid ounces) of a fuel additive comprising a fuel oil and a natural oil, per 60 to 80 liters (15.85 to 21.14 gallons) of gasoline, wherein the natural oil is derived from at least one of a plant and an animal.

7. The method according to claim 6, wherein in (a) the fuel oil is fuel oil number 2-D.

8. The method according to claim 7, wherein in (a) the natural oil is at least one of coconut oil, babassu oil, palm kernel oil, palm oil, olive oil, castor oil, rape oil, beef tallow oil, whale oil, sunflower oil, cottonseed oil, linseed oil, tung oil, tallow oil, lard oil, peanut oil, and soya oil.

9. The method according to claim 8, wherein in (a) the natural oil includes a blend of a refined olive oil and a virgin olive oil.

10. The method according to claim 6, wherein in (a) the natural oil and the fuel oil are present in the fuel additive in a ratio, by volume of about 1 part natural oil to about 8 parts fuel oil.

11. The method according to claim 6, further comprising:

b) prior to (a), cleaning the engine by adding 180 to 240 milliliters (6 to 8 fluid ounces) of the fuel additive per 60 to 80 liters (15.85 to 21.14 gallons) of gasoline, and running the engine for a selected driving interval.

12. The method according to claim 11, wherein the selected driving interval is 400 to 600 kilometers (248.60 to 372.90 miles).

* * * * *